US007719143B2

(12) United States Patent
Powell

(10) Patent No.: US 7,719,143 B2
(45) Date of Patent: May 18, 2010

(54) APPARATUS FOR PROVIDING AN AUXILIARY ELECTRICAL OUTLET

(75) Inventor: Roy Lloyd Powell, Edmonton (CA)

(73) Assignee: Impaact Innoventions Group Inc., Sherwood Park (CA)

( * ) Notice: Subject to any disclaimer, the term of this patent is extended or adjusted under 35 U.S.C. 154(b) by 253 days.

(21) Appl. No.: 12/054,253

(22) Filed: Mar. 24, 2008

(65) Prior Publication Data

US 2008/0239702 A1 Oct. 2, 2008

Related U.S. Application Data

(60) Provisional application No. 60/909,011, filed on Mar. 30, 2007.

(51) Int. Cl.
*H01B 7/30* (2006.01)

(52) U.S. Cl. ..... 307/147

(58) Field of Classification Search ..... 307/147
See application file for complete search history.

(56) References Cited

U.S. PATENT DOCUMENTS 7,064,269 B2 * 6/2006 Smith ..... 174/50

* cited by examiner

*Primary Examiner*—Robert L. DeBeradinis
(74) *Attorney, Agent, or Firm*—Parlee McLaw LLP; Johnny J. Haugen

(57) ABSTRACT

An apparatus is provided for mounting between a light fixture and an electrical box supplying a source of electrical power to the fixture where the apparatus includes an auxiliary electrical outlet that is electrically connected to the source of electrical power.

18 Claims, 8 Drawing Sheets

APPARATUS FOR PROVIDING AN AUXILIARY ELECTRICAL OUTLET

This application claims priority from U.S. Provisional Application No. 60/909,011 filed on Mar. 30, 2007.

FIELD OF INVENTION

The field of the present invention is related to the field of electrical devices for providing auxiliary electrical outlets, in particular, electrical devices configured to be mounted between a lighting fixture and an electrical box housing a source of electrical power for the fixture.

BACKGROUND

A large number of existing homes (such as older single-family houses, duplexes, multi-family apartment buildings, condominiums, etc.) do not have electrical outlets on the exterior of the home, or at least on the front exterior profile of the home, either for decorative lights, such as Christmas lights, or for providing outlets for electrical yard tools, such as weed-eaters, hedge trimmers, electrical lawnmowers or the like. An expensive solution is to hire an electrician to add new wiring to the home for exterior electrical outlets. Alternate solutions can include the use of devices having an outlet that screw into the light base of a fixture or to run extension cords from either the rear of the home or from the interior through a doorway or window. These solutions are less than ideal as they may not provide a grounded outlet and may also not comply with local electrical codes. Most homes, however, will have exterior light fixtures located near the entrances to the home.

It is, therefore, desirable to provide an electrical apparatus having an auxiliary electrical outlet for mounting between a light fixture and the electrical box the light fixture is attached to.

SUMMARY

An apparatus for providing an auxiliary electrical outlet is provided. In one embodiment, the apparatus can include a mounting ring that is placed between a light fixture and an electrical box that provides a source of electrical power for the fixture. In this manner, an auxiliary outlet is provided while still maintaining the existing light fixture. The mounting ring can be tubular and can have a circular or polygonal shape in cross-section to match the cross-sectional shape of the electrical box. The mounting ring can comprise a front surface that the light fixture is mounted against and a rear surface that is abutted against the electrical box. The mounting ring can include an opening to provide communication between the front and rear surfaces.

In one embodiment, the mounting ring can include mounting holes passing through the mounting ring between the front and rear surfaces whereby an extended fastener can be used to secure the fixture to the electrical box by passing through the mounting holes thereby sandwiching the mounting ring between the light fixture and the electrical box. In another embodiment, the mounting ring can be mounted to the electrical box with a first set of fasteners and the light fixture can be mounted to the mounting ring with a second set of fasteners.

In another embodiment, the mounting ring can include a housing disposed thereon. The housing can include at least one electrical outlet. In this embodiment, the electrical leads from the outlet can extend from the housing through the mounting ring into the opening where they can be connected to the electrical supply leads in the electrical box. In this fashion, the outlet is wired "in parallel" with the light fixture as well known by those skilled in the art. For the purposes of this specification, references to the electrical supply leads located in the electrical box will be made in the context that the supply leads provide 60 hertz, single-phase 120 volts AC electrical power as commonly used in North America. It should be obvious to those skilled in the art that the apparatus described herein can be adapted for use with 50 or 60 hertz, 220-240 volts AC electrical power as commonly used in other parts of the world.

In one embodiment, the housing can extend from one side of the mounting ring whereby the auxiliary electrical outlet generally faces outwardly in the same direction as the front surface of the mounting ring. In another embodiment, one or more housings can extend outwardly from the side of the mounting ring whereby the auxiliary electrical outlet generally faces perpendicular from the front surface. In either of these embodiments, the auxiliary electrical outlet can be a conventional grounded outlet or it can be a ground-fault interrupter ("GFI") type of outlet as well known in the art with the trip/reset buttons of the outlet mounted on the housing in order to comply with local electrical codes. In further embodiments, the apparatus can also include an infrared ("IR") sensor control mechanism to control the supply of electrical power to either or both of the light fixture and the auxiliary electrical outlet. As well known to those skilled in the art, IR sensors can be used as motion detectors on light fixtures to turn on the light when the sensor detects a sufficient amount of infrared heat emanating from a person or an animal as they pass within a predetermined distance from the sensor. The apparatus can further include an electrical switch for manually applying power to the auxiliary electrical outlet that can be used by itself or in combination with the IR sensor control mechanism such that power is provided to the auxiliary outlet when the IR sensor is activated. The apparatus can also include a switching mechanism that can select whether the auxiliary outlet is manually turned on or off, or turned on or off when the IR sensor control mechanism is activated. In other embodiments, a light sensor control mechanism can be used in place of the IR sensor control mechanism so that the light fixture can be activated at dusk and turned off at dawn. In yet further embodiments, the apparatus can be provided solely with an IR sensor and/or a light sensor without the auxiliary outlet so that an existing light fixture can have motion detection capability and/or can be turned on at dusk and off at dawn. In yet another embodiment, the apparatus can comprise a temperature sensor to turn on the light fixture and/or the auxiliary outlet at a first predetermined temperature. In other embodiments, the light fixture and/or the auxiliary outlet can be turned off at a second predetermined temperature. This functionality can be used, as an example, to turn on power to a motor vehicle's block heater connected to the auxiliary outlet when the temperature drops below a predetermined temperature.

Broadly stated, an apparatus is provided for mounting between a light fixture and an electrical box providing a source of electrical power, the apparatus comprising: a mounting ring configured to be held in position between said fixture and said box when said fixture is operatively attached to said box, said mounting ring providing an opening for the electrical leads of said fixture to pass through to said box; a housing operatively disposed on said mounting ring; and at least one electrical outlet disposed in said housing whereby said at least one outlet is accessible when said mounting ring is positioned between said fixture and said box, said outlet configured to be operatively connected to said source of electrical power.

Broadly stated, an apparatus is provided for mounting between a light fixture and an electrical box providing a source of electrical power, the apparatus comprising: a mounting ring configured to be held in position between said fixture and said box when said fixture is operatively attached to said box, said mounting ring providing an opening for the electrical leads of said fixture to pass through to said box; a housing operatively disposed on said mounting ring; and means for controlling the supply of electrical power from said electrical power source to said light fixture disposed within said housing.

DETAILED DESCRIPTION OF EMBODIMENTS

Figure 1:
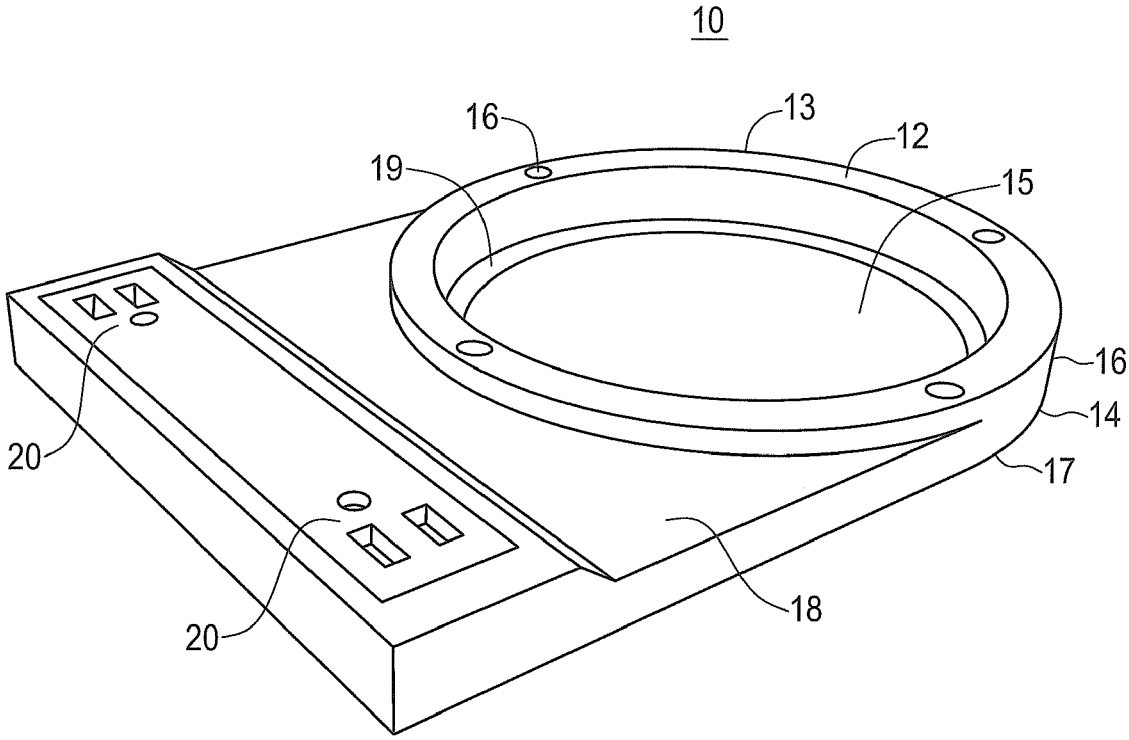
FIG. 1 is a perspective view depicting one embodiment of an apparatus having an auxiliary electrical outlet.

Referring to FIG. 1, one embodiment of apparatus having an auxiliary electrical outlet is shown. Apparatus 10 can include mounting ring 12 having front surface 13, side surface 14 and rear surface 17. Opening 15 extends through mounting ring 12 from front surface 13 to rear surface 17. Apparatus 10 can also include mounting flange 19 and mounting holes 16. In the illustrated embodiment, housing 18 extends from side surface 14 of mounting ring 12. Housing 18 can include electrical outlets 20. Electrical wires operatively coupled to electrical outlets 20 (not shown) can extend through mounting ring 12 into opening 15 where they can be coupled to electrical supply leads as well known to those skilled in the art.

Figure 2:
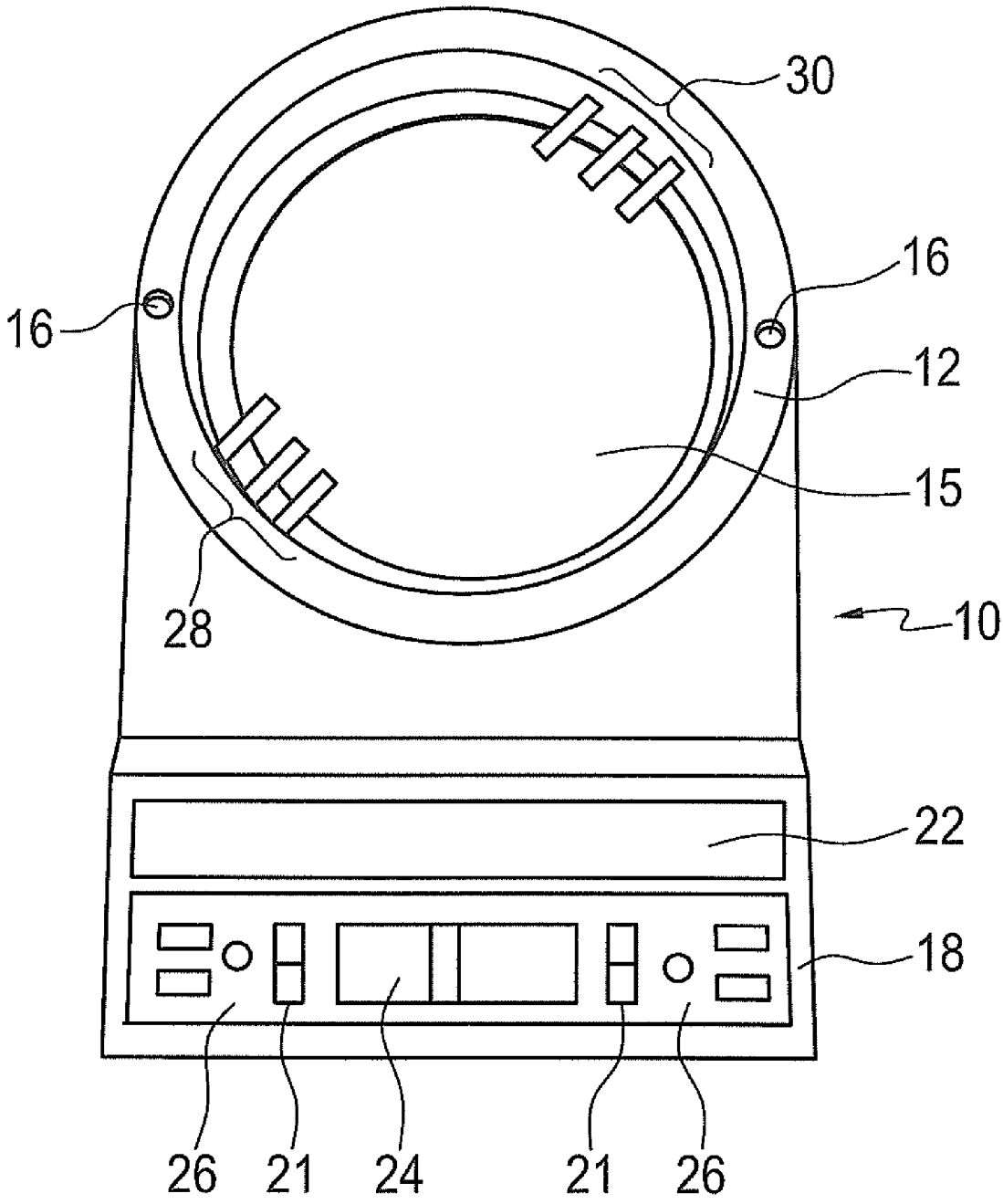
FIG. 2 is a front elevational view depicting a second embodiment of the apparatus of FIG. 1.

Referring to FIG. 2, an alternate embodiment of apparatus 10 is shown. In this embodiment, housing 18 can comprise GFI outlets 26. Accordingly, housing 18 can also comprise the trip/rest buttons 21 for GFI outlets 26. In a further embodiment, apparatus 10 can include sensor 22, in combination with electrical circuitry located in housing 18 (not shown), to control the supply of electrical power to GFI outlets 26, to the light fixture that is attached to apparatus 10 (not shown) or to both. In one embodiment, sensor 22 can comprise an IR sensor. As well known to those skilled in the art, IR sensors have long been used as motion detectors in exterior light fixtures. By incorporating sensor 22 into apparatus 10, an existing light fixture can then be converted to a light fixture having motion detection capability.

Apparatus 10 can also include switch 24 that can be configured to manually apply electrical power to GFI outlets 26 or to the light fixture or to both as would be obvious to those skilled in the art. As is obvious to those skilled in the art, switch 24 can be an electro-mechanical switch and can be single-pole/single throw (SPST) switches, single-pole/double-throw (SPDT) switches, double-pole/double-throw (DPDT) switches or any other functional equivalent switching device that can be used to switch electrical power. These other switching devices can include solid-state switches such as bipolar transistors, field-effect transistors, insulated-gate bipolar transistors, triacs or any other suitable electronic switching devices.

Referring back to FIG. 2, input wire leads 28 extend from mounting ring 12 into opening 15 and are used to connect to electrical power supply leads located in an electrical box (not shown). In this configuration, apparatus 10 can be wired "in parallel" with the light fixture attached thereon. In another embodiment, apparatus 10 can also include fixture wire leads 30 extending from mounting ring 12 into opening 15. In this configuration, the light fixture is wired to fixture wire leads 30 so that the electrical power supplied to the light fixture can be controlled by IR sensor 22, switch 24 or both. Located within housing 18 is electrical switching circuitry (not shown) comprising a transistor, a triac or any other suitable solid-state semiconductor switching device, as well known to those skilled in the art, that can be controlled by sensor 22 in switching electrical power from the power supply leads to the light fixture and/or to outlet 20 or 26.

In other embodiments, sensor 22 can comprise a light detecting sensor (not shown), as well known to those skilled in the art, operatively coupled to the electrical switching circuitry so that the light fixture can be turned on at dusk and turned off at dawn. In yet further embodiments, apparatus 10 can be provided with either an IR sensor and/or a light-detecting sensor and without auxiliary outlet 20 or 26 so as to provide a device that can convert existing light fixtures into light fixtures having motion detection and/or light detection capability. In yet another embodiment, sensor 22 can comprise a temperature sensor to turn the light fixture and/or auxiliary outlet 20 or 26 on or off at predetermined temperatures.

Figure 3:
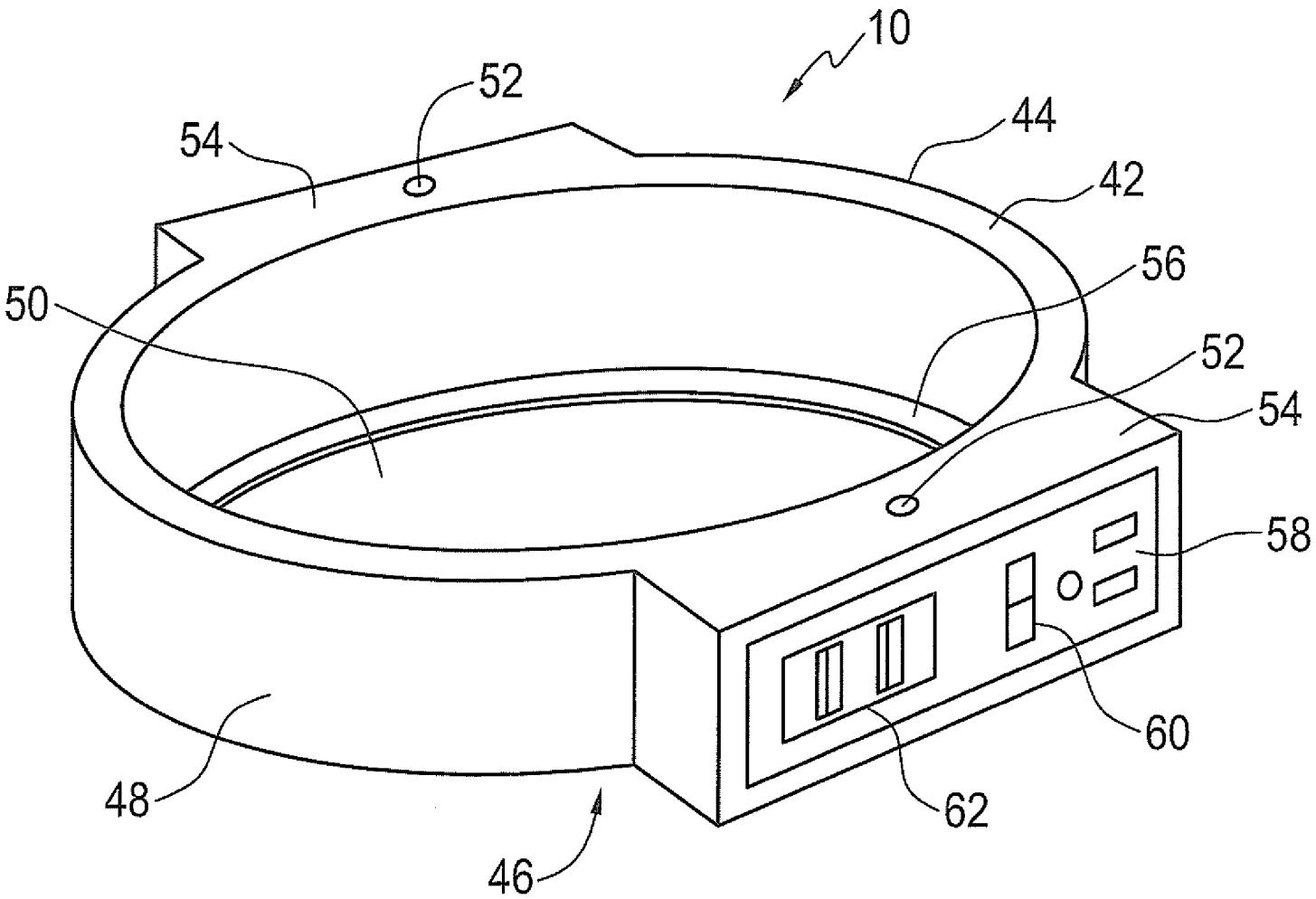
FIG. 3 is a perspective view depicting a third embodiment of the apparatus of FIG. 1.

Referring to FIG. 3, a further alternate embodiment of apparatus 10 is shown. In this embodiment, apparatus 10 can comprise mounting ring 42 with one or more housings 53 extending from side surface 48 of mounting ring 42. In this embodiment, apparatus 10 has front surface 44 and rear surface 46. Mounting flange 56 is included for abutting against an electrical box. Mounting holes 52 pass through housings 54 to permit a fastener (not shown) to pass through and fasten to an electrical box (not shown). Housings 54 can further include outlets 58 and switch 62 for manually controlling electrical power to outlets 58 and/or the light fixture attached to apparatus. In the illustrated embodiment, outlets 58 are of the GFI variety and include trip/reset buttons 60.

Figure 4:
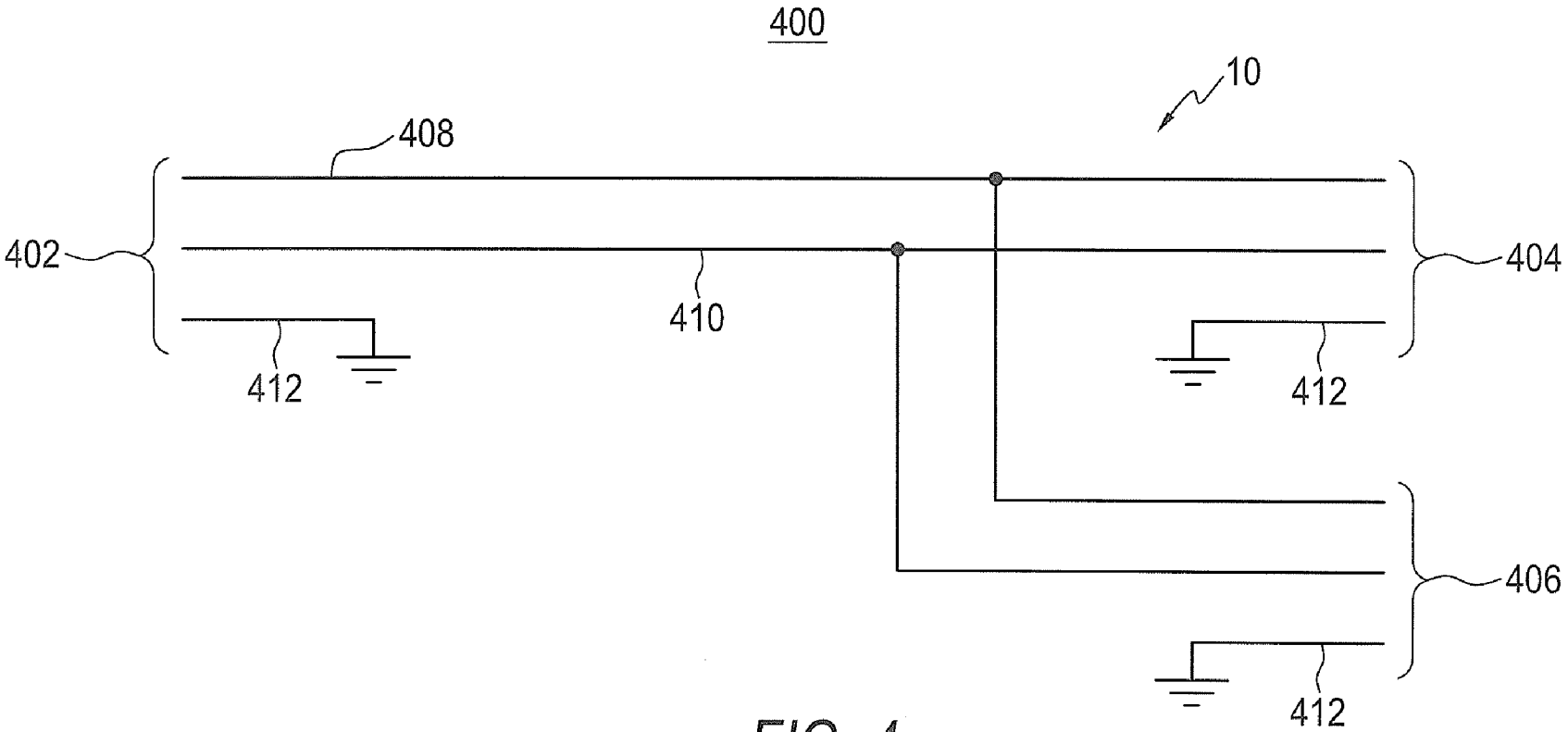
FIG. 4 is an electrical schematic depicting the electrical circuit of the apparatus of FIG. 1.

Referring to FIG. 4, electrical wiring schematic 400 illustrates a basic wiring configuration of apparatus 10. Auxiliary outlet electrical leads 406 are wired "in parallel" with light fixture electrical leads 404 to power source electrical leads 402 consisting of line lead 408, neutral lead 410 and ground lead 412.

Figure 5:
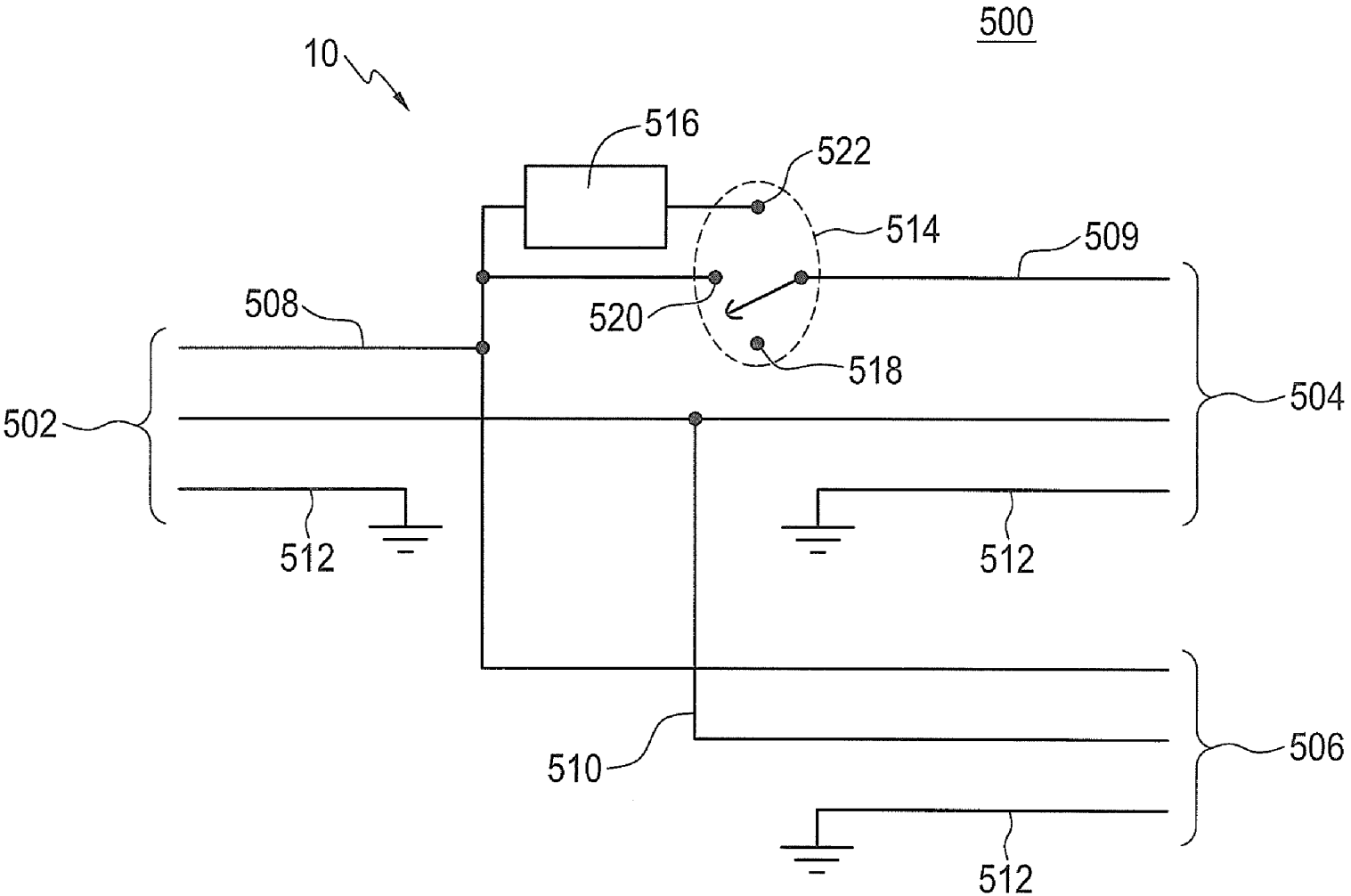
FIG. 5 is an electrical schematic depicting one embodiment of the electrical circuit of the apparatus of FIG. 2.

Referring to FIG. 5, electrical wiring schematic 500 illustrates an alternate configuration of apparatus 10 that includes sensor control circuitry 516 and switch 514 to control power to light fixture electrical leads 504. In this embodiment, auxiliary outlet electrical leads 506 are wired directly to power source electrical leads 502 consisting of line lead 508, neutral lead 510 and ground lead 512. Light fixture line lead 509 is connected to the common terminal of switch 514. When switch 514 is set to off position 518, the power to line lead 509 is turned off. When switch 514 is set to on position 520, the power to line lead 509 is turned on. When switch 514 is set to position 522, the power to line lead 509 is controlled by sensor control circuitry 516. In this embodiment, the power to light fixture electrical leads 504 is set by a user through switch 514.

Figure 6:
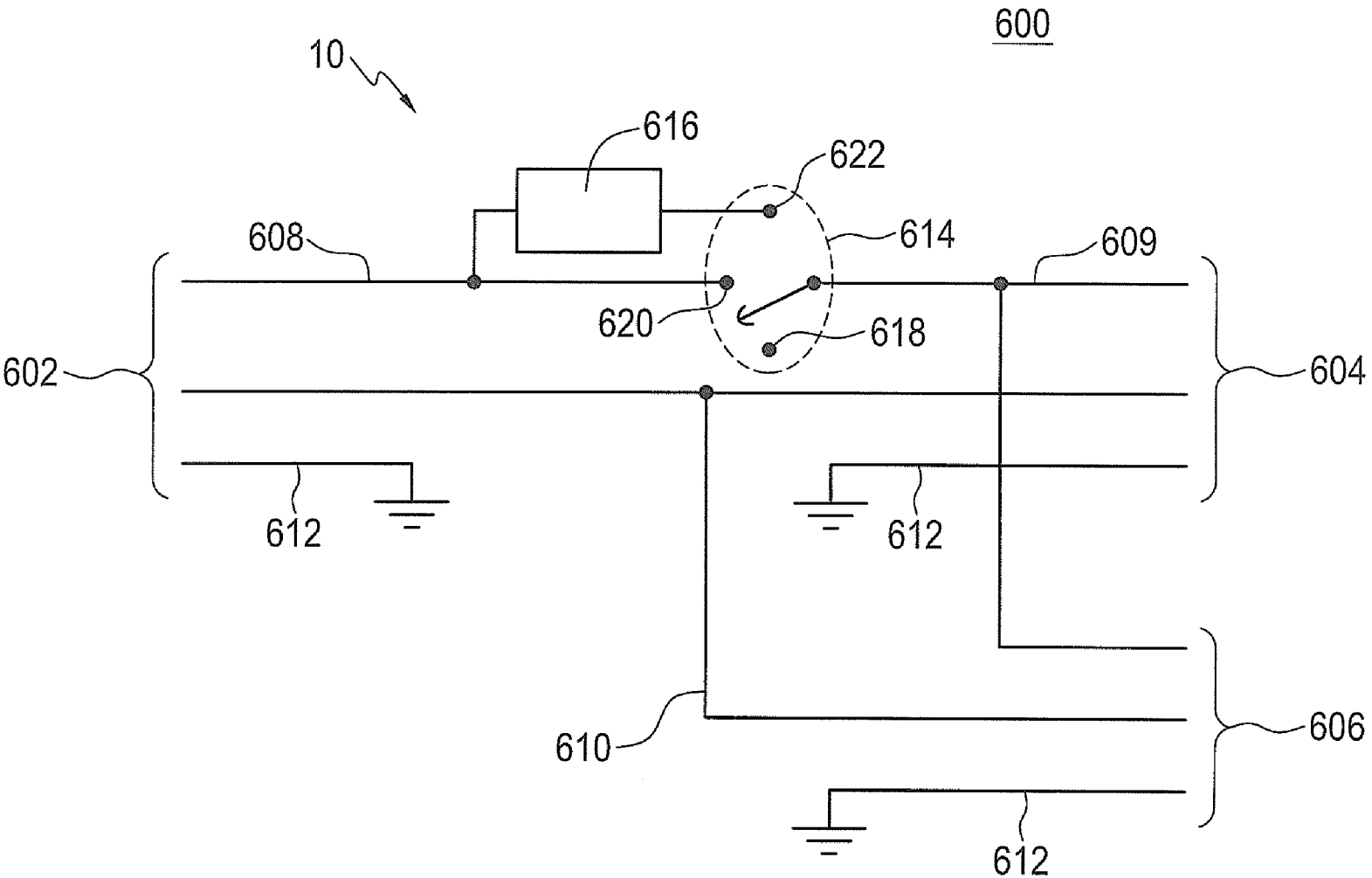
FIG. 6 is an electrical schematic depicting a second embodiment of the electrical circuit of the apparatus of FIG. 2.

Referring to FIG. 6, electrical wiring schematic 600 illustrates an alternate configuration of apparatus 10 that includes sensor control circuitry 616 and switch 614 to control power to light fixture electrical leads 604. In this embodiment, auxiliary outlet electrical leads 606 are wired directly to light fixture electrical leads 604, which are, in turn, connected to power source electrical leads 602 consisting of line lead 608, neutral lead 610 and ground lead 612 through switch 614. Light fixture line lead 609 is connected to the common terminal of switch 614. When switch 614 is set to off position 618, the power to line lead 609 is turned off. When switch 614 is set to on position 620, the power to line lead 609 is turned on. When switch 614 is set to position 622, the power to line lead 609 is controlled by sensor control circuitry 616. In this embodiment, the power to light fixture electrical leads 604 and to auxiliary outlet electrical leads 606 is set by a user through switch 614.

Figure 7:
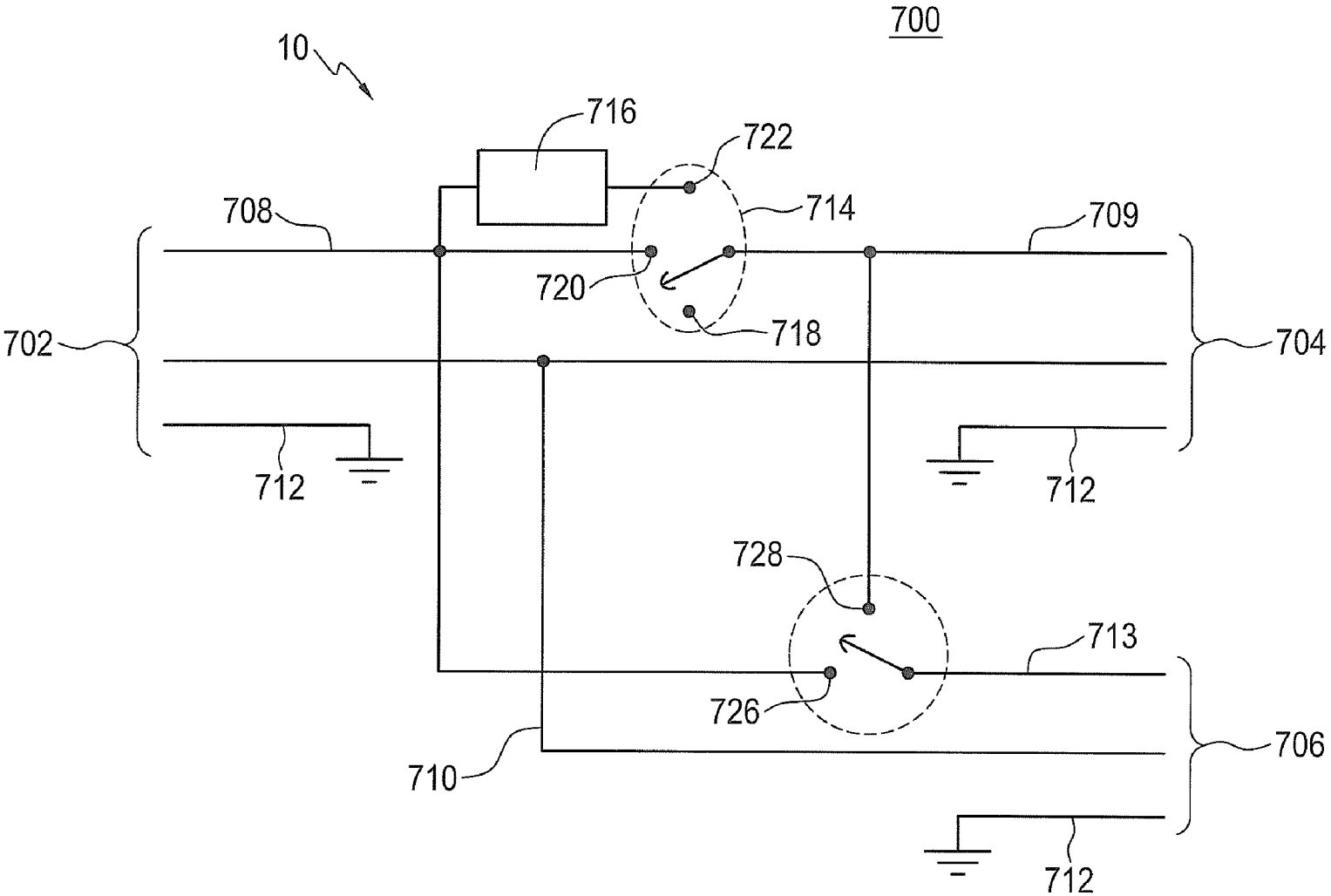
FIG. 7 is an electrical schematic depicting a third embodiment of the electrical circuit of the apparatus of FIG. 2.

Referring to FIG. 7, electrical wiring schematic 700 illustrates an alternate configuration of apparatus 10 that includes sensor control circuitry 716 and switch 714 to control power to light fixture electrical leads 704 in addition to switch 724 to control the supply of power to line lead 713 to auxiliary outlet electrical leads 706 either from power source electrical leads 702 consisting of line lead 708, neutral lead 710 and ground lead 712 or from switch 714. In this embodiment, line lead 713 can be connected to line lead 708 when switch 724 is set to position 726. Further, line lead 713 can be connected to line lead 709 when switch 724 is set at position 728. Light fixture line lead 709 is connected to the common terminal of switch 714. When switch 714 is set to off position 718, the power to line lead 709 is turned off. When switch 714 is set to on position 720, the power to line lead 709 is turned on. When switch 714 is set to position 722, the power to line lead 709 is controlled by sensor control circuitry 716. In this embodiment, the power to auxiliary outlet electrical leads 706 can be set independently from how power is connected to light fixture electrical leads 704 or set to track how power is connected to light fixture electrical leads 704 depending on how a user sets switches 724 and 714.

In each of the embodiments shown in FIGS. 5, 6 and 7, the sensor control circuitry can be replaced by or can further include a light sensor control circuitry so as to include the ability to turn on the light fixture and/or the auxiliary outlet at dusk and turn them off at dawn. In addition, the sensor control circuitry can be replaced by or can further include a temperature sensor so as to the ability to turn on (or off) the light fixture and/or the auxiliary outlet at one or more predetermined temperatures.

Figure 8:
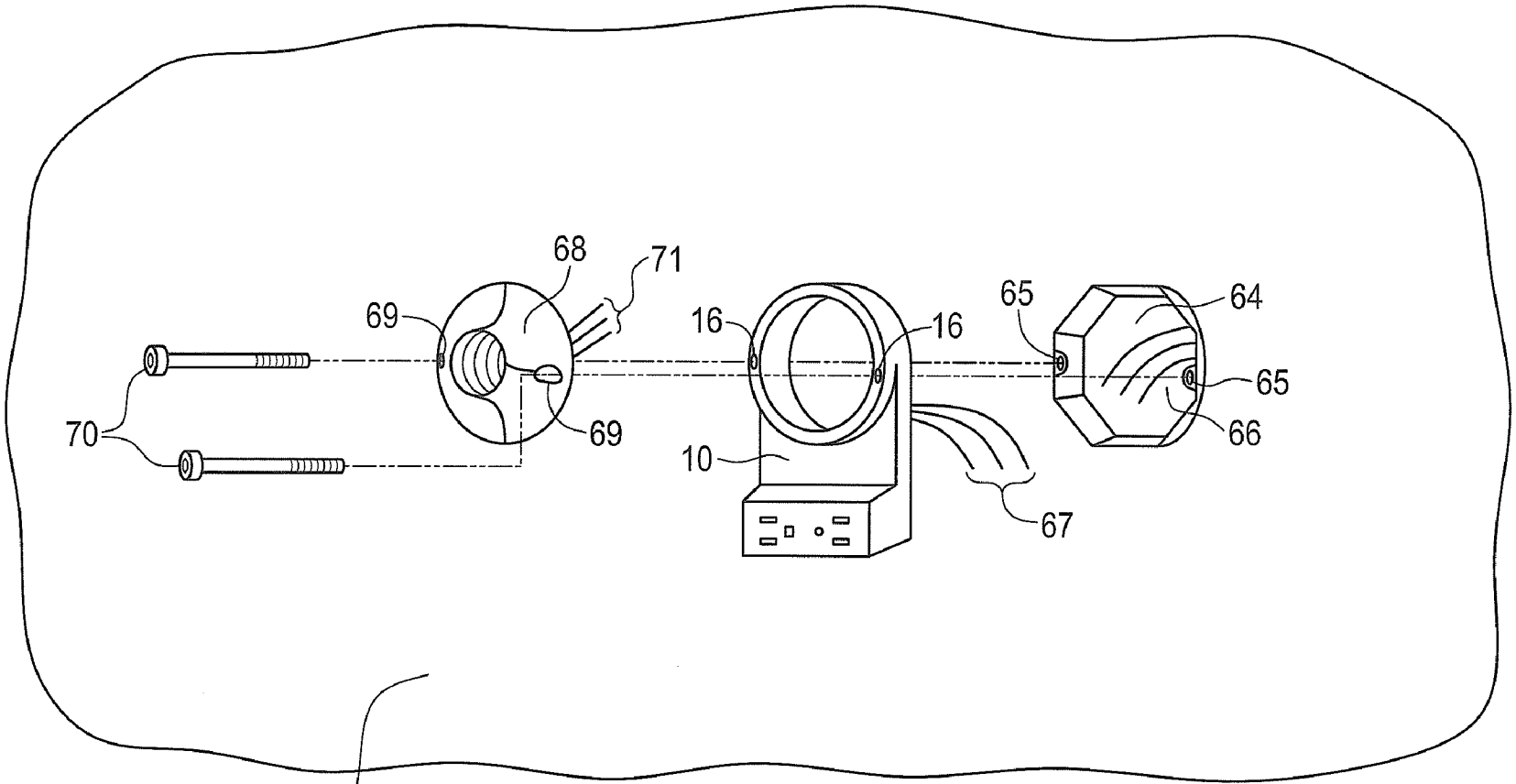
FIG. 8 is a perspective view depicting the apparatus of FIG. 1 being mounted on a wall.

Referring to FIG. 8, apparatus 10 is shown being mounted to electrical box 64 on wall 63. In this figure, an embodiment of apparatus 10 as shown in FIG. 1 is shown being simply wired in parallel with light fixture 68 where fixture wire leads 71 and outlet wire leads 67 can be spliced with line wire leads 66 in box 64 to provide an auxiliary electrical outlet that is energized whenever light fixture 68 is turned on. The term "spliced" refers to the ground wires, the neutral wires and the line or "hot" wires being joined together, respectively. In another embodiment, the embodiment of apparatus 10 as shown in FIG. 2 can be used to provide an auxiliary electrical outlet that can be energized in the ways described in this specification. In this embodiment, input wire leads 28 (as shown in FIG. 2) can be spliced to line wire leads 66 and fixture wire leads 30 (as shown in FIG. 2) can be spliced to fixture wire leads 71. Once the electrical connections have been made, fasteners 70, such as threaded fasteners as an example, pass through openings 69 in light fixture 68 to pass through openings 16 in mounting ring 12 to attach to mounting tabs 65 in box 64. As fasteners 70 are secured tightly to mounting tabs 65, apparatus 10 is sandwiched between light fixture 68 and electrical box 64. It is obvious to those skilled in the art that weather stripping can be applied between light fixture 68 and apparatus 10 as well as between apparatus 10 and electrical box 64 to minimize the influx of moisture into opening 15. For illustration purposes only, light fixture 68 is shown in FIG. 8 as a simple light fixture for a standard light bulb. It is obvious to those skilled in the art that any suitable light fixture can be used other than the one shown in FIG. 8.

In a further embodiment, a kit can be provided that comprises of apparatus 10 and a set of instructions on how to connect apparatus 10 between light fixture 68 and box 64. In another embodiment, the kit can further comprise light fixture 68. In yet further embodiments, light fixture 68 can be integral to apparatus 10 or integral to mounting ring 12 or mounting ring 42, depending on the embodiment of apparatus 10 that light fixture 68 is integral to.

Although a few illustrative embodiments have been shown and described, those skilled in the art will appreciate that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the scope of the invention is defined and limited only by the claims that follow.

I claim:

1. An apparatus for mounting between a light fixture and an electrical box providing a source of electrical power, the apparatus comprising:

a) a mounting ring configured to be held in position between the fixture and the box when the fixture is operatively attached to the box, the mounting ring providing an opening for the electrical leads of the fixture to pass through to the box;

b) a housing operatively disposed on the mounting ring; and c) at least one electrical outlet disposed in the housing whereby the at least one outlet is accessible when the mounting ring is positioned between the fixture and the box, the at least one outlet configured to be operatively connected to the source of electrical power.

2. The apparatus as set forth in claim 1 further comprising means for controlling the supply of electrical power to the fixture and to the at least one outlet.

3. The apparatus as set forth in claim 2 wherein the means comprises an electrical switch for controlling electrical power supplied to either or both of the fixture and the at least one outlet.

4. The apparatus as set forth in claim 3 wherein the electrical switch comprises an electromechanical switch.

5. The apparatus as set forth in claim 3 wherein the electrical switch comprises a solid-state switching device.

6. The apparatus as set forth in claim 2 wherein the means further comprises a motion detection sensor configured for controlling the source of electrical power.

7. The apparatus as set forth in claim 2 wherein the means further comprises a light detection sensor configured for controlling the source of electrical power.

8. The apparatus as set forth in claim 2 wherein the means further comprises a temperature sensor configured for controlling the source of electrical power.

9. The apparatus as set forth in claim 1 further comprising the light fixture.

10. The apparatus as set forth in claim 9 wherein the light fixture is integral to the mounting ring.

11. An apparatus for mounting between a light fixture and an electrical box providing a source of electrical power, the apparatus comprising:

a) a mounting ring configured to be held in position between the fixture and the box when the fixture is operatively attached to the box, the mounting ring providing an opening for the electrical leads of the fixture to pass through to the box;

b) a housing operatively disposed on the mounting ring; and c) means for controlling the supply of electrical power from the electrical power source to the light fixture, the means disposed within said housing.

12. The apparatus as set forth in claim 11 wherein said means further comprises one or more from the group consisting of an infrared sensor control mechanism, a light sensor control mechanism and a temperature control mechanism.

13. The apparatus as set forth in claim 11 further comprising the light fixture.

14. The apparatus as set forth in claim 13 wherein the light fixture is integral to the mounting ring.

15. The apparatus as set forth in claim 13 wherein the housing further comprises at least one electrical outlet configured to be connected to the source of electrical power.

16. A kit, comprising:

a) an apparatus for mounting between a light fixture and an electrical box providing a source of electrical power, the apparatus comprising:

i) a mounting ring configured to be held in position between the fixture and the box when the fixture is operatively attached to the box, the mounting ring providing an opening for the electrical leads of the fixture to pass through to the box, ii) a housing operatively disposed on the mounting ring, and iii) at least one electrical outlet disposed in the housing whereby the at least one outlet is accessible when the mounting ring is positioned between the fixture and the box, the at least one outlet configured to be operatively connected to the source of electrical power; and b) a set of instructions on how to connect the apparatus between the light fixture and the electrical box.

17. The kit as set forth in claim 16 further comprising the light fixture.

18. The kit as set forth in claim 17 wherein the light fixture is integral to the mounting ring.

* * * * *